US007384347B2

(12) United States Patent
Milne

(10) Patent No.: US 7,384,347 B2
(45) Date of Patent: Jun. 10, 2008

(54) GOLF BALL RETRIEVAL DEVICE

(76) Inventor: Tommy Milne, 35 Bower Road, Semaphore South (AU) 5019

( * ) Notice: Subject to any disclaimer, the term of this patent is extended or adjusted under 35 U.S.C. 154(b) by 0 days.

(21) Appl. No.: 10/595,160

(22) PCT Filed: Sep. 6, 2004

(86) PCT No.: PCT/AU2004/001171

§ 371 (c)(1),
(2), (4) Date: Mar. 10, 2006

(87) PCT Pub. No.: WO2005/023378

PCT Pub. Date: Mar. 17, 2005

(65) Prior Publication Data

US 2007/0010345 A1 Jan. 11, 2007

(30) Foreign Application Priority Data

Sep. 10, 2003 (AU) ..... 2003904940

(51) Int. Cl.
*A63B 47/02* (2006.01)

(52) U.S. Cl. ..... 473/286; 294/19.2

(58) Field of Classification Search ..... 473/286; 294/19.2

See application file for complete search history.

(56) References Cited

U.S. PATENT DOCUMENTS 2,968,509 A * 1/1961 Borah ..... 294/19.2
4,746,156 A * 5/1988 Kremer ..... 294/19.2
5,004,240 A 4/1991 Tsukamoto
5,335,953 A 8/1994 Luther
5,672,121 A 9/1997 Miller
5,707,303 A 1/1998 Berkowitz et al.
6,638,177 B1 * 10/2003 Wang ..... 473/286
6,716,118 B1 * 4/2004 Asta ..... 473/406

FOREIGN PATENT DOCUMENTS

| | | |
|---|---|---|
| FR | 2775908 A1 | 9/1999 |
| GB | 2274786 A | 8/1994 |
| GB | 2294404 A | 5/1996 |
| GB | 2305865 A | 4/1997 |
| GB | 2352638 A | 2/2001 |

* cited by examiner

*Primary Examiner*—Stephen Blau
(74) *Attorney, Agent, or Firm*—Brooks Kushman P.C.

(57) ABSTRACT

A golf ball retrieval device (1) comprising: plurality of ball engaging members (3), an abutment member (4), a base member (8), the ball engaging members being held in a closely adjacent configuration by resilient means (7), thereby forming an open ended convolute sided cup shape (FIG. 1) wherein the end abutment member (4) covers an otherwise open area between the ends of the fingers distal from the base member.

9 Claims, 7 Drawing Sheets

GOLF BALL RETRIEVAL DEVICE

TECHNICAL FIELD

The present invention relates to a device for retrieving golf balls from the ground, or from the bottom of a cup set into a golf course green.

BACKGROUND ART

Golf is one of the more popular games in the world. It is played by players with a very wide range of fitness levels and physical abilities. One of the difficulties faced by less fit players and particularly by older players is the need to bend down retrieve the ball from the ground. This is particularly a problem when the ball must be retrieved from the hole or cup on a golf course green after successfully sinking a putt.

There have been numerous devices described aimed at overcoming this difficulty.

U.S. Pat. No. 1,658,145 describes a device for fitting to a caddy club or golf club. The device has a number of flexible, resilient fingers curved to rest on top of and to deform over and grip a golf ball between them on application of downward pressure to the shaft of the club. The fingers are formed from two ribbons of metal both bent into a U shape with one fitted within and perpendicular to the other.

A problem with many of these devices is visual obtrusiveness. This reduces the visual attractiveness of any club to which they might be attached, giving the club a mechanical appearance not in keeping with the image of the game. Further it makes it clear to any observer that the club user employs a retrieval device which may be embarrassing to the user.

It would also be expected that if many of these devices were fitted to the handle of a club, the ball engaging apparatus would catch on the person or clothing of the user.

A usual manner of storage of golf clubs is with the handle downward inside a golf bag. In such a position, many available retrieval devices would be susceptible to damage or might cause damage to other clubs or to the bag or in another case be vulnerable to being dislodged when the club is withdrawn.

DISCLOSURE OF THE INVENTION

In one form of the invention, it may be said to reside in a golf ball retrieval device with a base adapted to be located on and secured to an upper end of a golf club shaft the retrieval device having at least two fingers projecting from the base substantially parallel to an axis running along the length of the club shaft a resilient support being provided at the base adapted to allow each finger independently from the other finger or fingers to be movable with respect to the body so as to be able to be pivoted about the base such that an end of the respective finger distal from the base will swing outwardly and allow thereby against resilient pressure a spread of the fingers to provide a golf ball capturing space.

In preference there is a shaft aligned to extend along an elongate axis of the base of the retrieval device said shaft supporting an abutment member at a forward end of the shaft so that when in a resting position this is positioned at an end distal from the base of the retrieval device.

In preference there is a spring effecting a bias to urge the shaft with the abutment member into an outwardmost position relative to the base, such that when the fingers are in a closed position where this is the resting position the abutment member extends across an area between outer ends of the respective fingers.

In preference there is a cam member slidably supported by the shaft and resiliently biased into an outwardmost position relative to the base which is inward of the said abutment member and adapted to effect when inwardly moved relative to the fingers an engagement against an inner surface of each of these fingers and effect through such engagement a further spread of the fingers.

In preference there is a helical spring between the said cam and the said base.

In a more preferred form there are three fingers symmetrically aligned about a central axis of the body of the golf ball retrieval device.

In a further form the invention may reside in a putter in combination with a ball retrieval device as characterized in any of the statements herein.

In preference the ball-retrieval device has a stem that is embedded in an end of a shaft of the putter.

In a further preferred form, the invention may be characterized by a golf ball retrieval device having a plurality of resiliently held fingers which are shaped at their respective ends and aligned relatively one to the other such that when urged against the surface of a golf ball the fingers will be caused to spread against resilient pressure such that it will enable a golf ball to enter and be held therebetween.

In preference the fingers have supported therebetween an abutment member which when the retrieval device is in a resting position extends across an area defined by ends of the fingers. The abutment member is divertable when the fingers are being urged against the surface of a golf ball.

In a further form, the invention may be said to reside in a golf ball retrieval device having a plurality of ball engaging members, an end abutment member and a base member. The ball engaging members are held in a closely adjacent configuration by resilient means, thereby forming an open ended convolute sided cup shape. The end abutment member covers an otherwise open area between the ends of the fingers distal from the base member.

In preference the abutment member is supported by a resilient support, said support being substantially co-axial with a longer axis of the convolute sided cup shape.

In preference the abutment member is adapted to be pressed against a golf ball, whereby the support is deformed and the abutment member moves axially inside the convolute sided cup shape, remaining in contact with the ball. The ball comes into with the ball engaging members, and the members are forced apart by the force transmitted by the ball allowing the ball to move in between them, with the members being urged to grip the ball by the resilient means.

In preference the abutment member and the ball engaging members co-operate such that as the abutment member moves axially inside the convolute sided cup shape, the ball engaging members are forced further apart by the movement of the abutment member, allowing the ball to move completely between the ball engaging members. The ball is held in place by the resilient means urging the ball engaging members against the ball, and by the resilient support urging the abutment member against the ball, further urging the ball against the ball engaging members.

BRIEF DESCRIPTION OF THE DRAWINGS

The present invention will be better understood by reference to a preferred embodiment which shall be described with the assistance of drawings wherein.

BEST MODE FOR CARRYING OUT THE INVENTION

Figure 1:
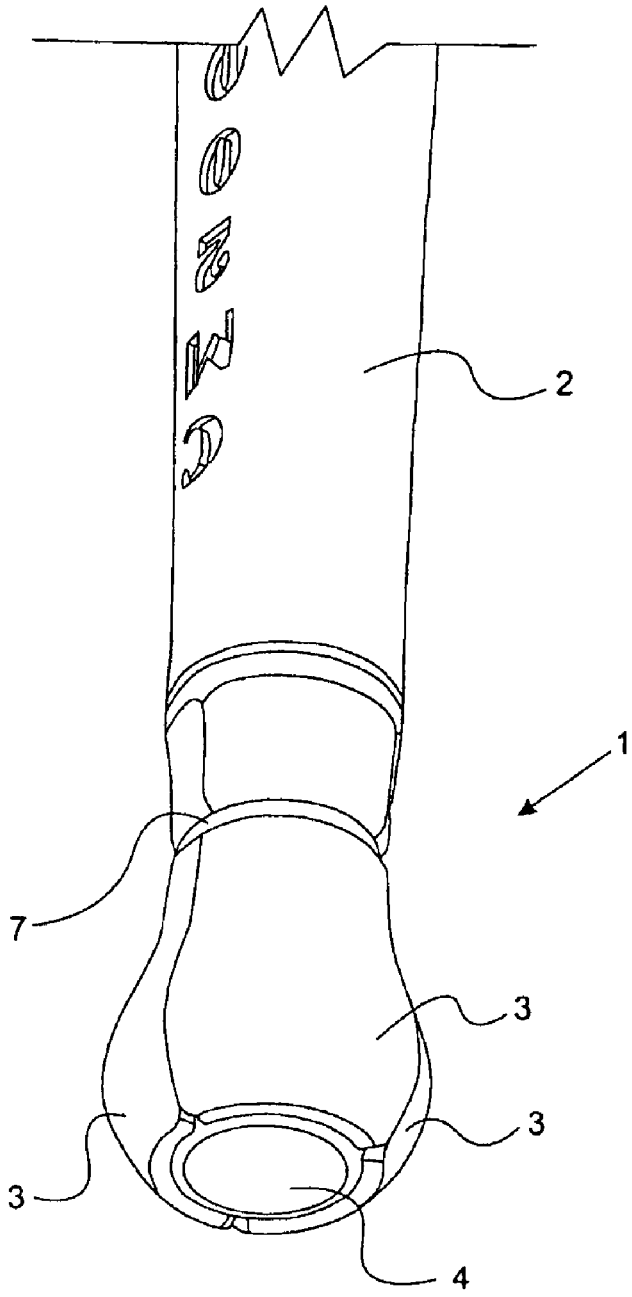
FIG. 1 is a perspective view of a retrieval device made in accordance with the embodiment.

Referring to the drawings in detail and especially in relation to FIG. 1, there is a golf ball retrieval device 1 attached to a golf club shaft 2. As may be more clearly seen in FIG. 5, the golf ball retrieval device is attached to the hollow shaft by an interference fit between an inner wall 50 of the shaft and a stem 51 of the golf ball retrieval device 1. In other embodiments, the attachment may be by way of a screw thread or adhesive means.

There are three ball engaging fingers 3, which together form a convolute sided cup, open toward an end remote from the club shaft. A resilient torus 7, acts to urge the fingers together to form the cup.

The open end of the cup in its resting position is covered by an abutment member in the form of a disc 4, thus giving the golf ball retrieval device a closed bulbous appearance.

Figure 2:
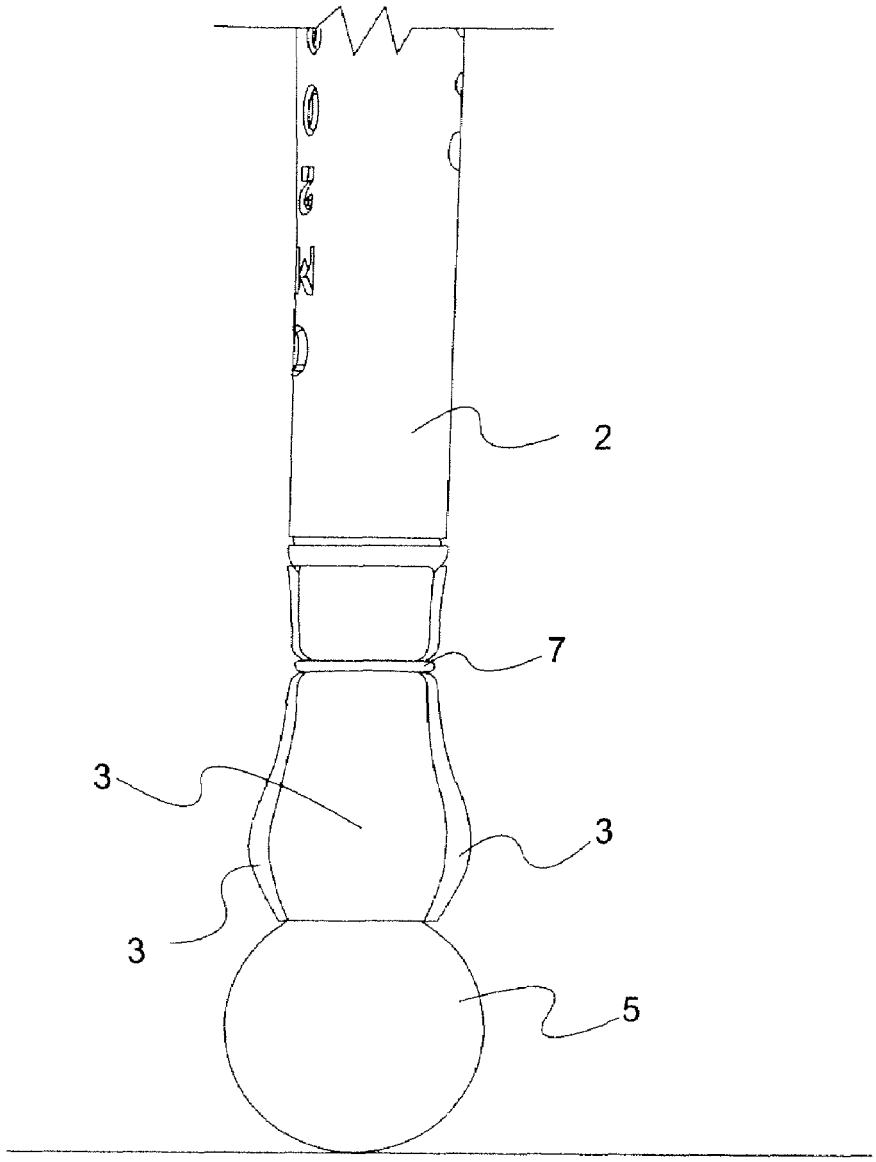
FIG. 2 is a view of the embodiment of FIG. 1 about to engage a golf ball.
Figure 3:
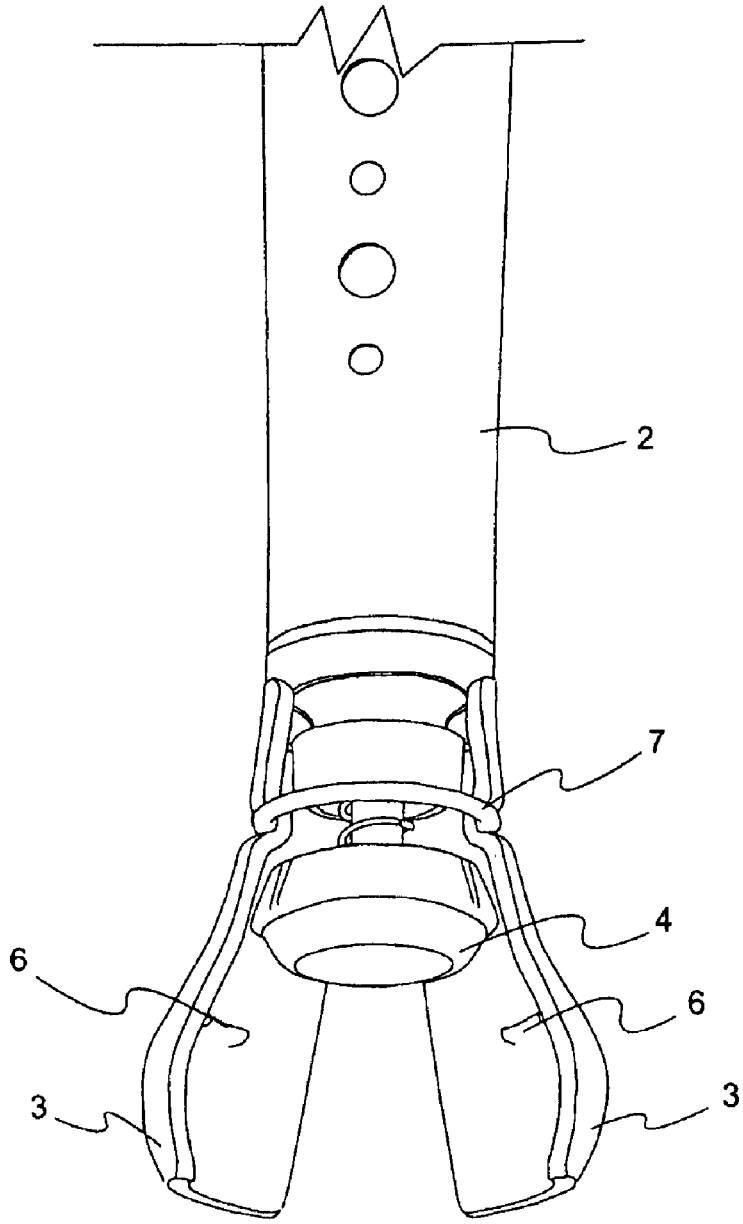
FIG. 3 is a view of the embodiment of FIG. 1 with one ball engaging member removed.

FIG. 2 shows the golf ball retrieval device in position over a golf ball 5. The shaft of the golf club is then pushed downward, trapping the ball between the golf ball retrieval device and the ground surface. Further downward pressure causes the fingers 3 to begin to separate, and the abutment member to be forced into the space surrounded by the fingers. This is shown in FIG. 3, where both the ball and one finger have been omitted for clarity. It can be seen that the parting of the fingers has formed a space into which the ball passes and is held. As the ball passes into the space, it encounters and presses against lugs 6, thus further separating the fingers and enlarging the space which is to accommodate the ball.

Figure 4:
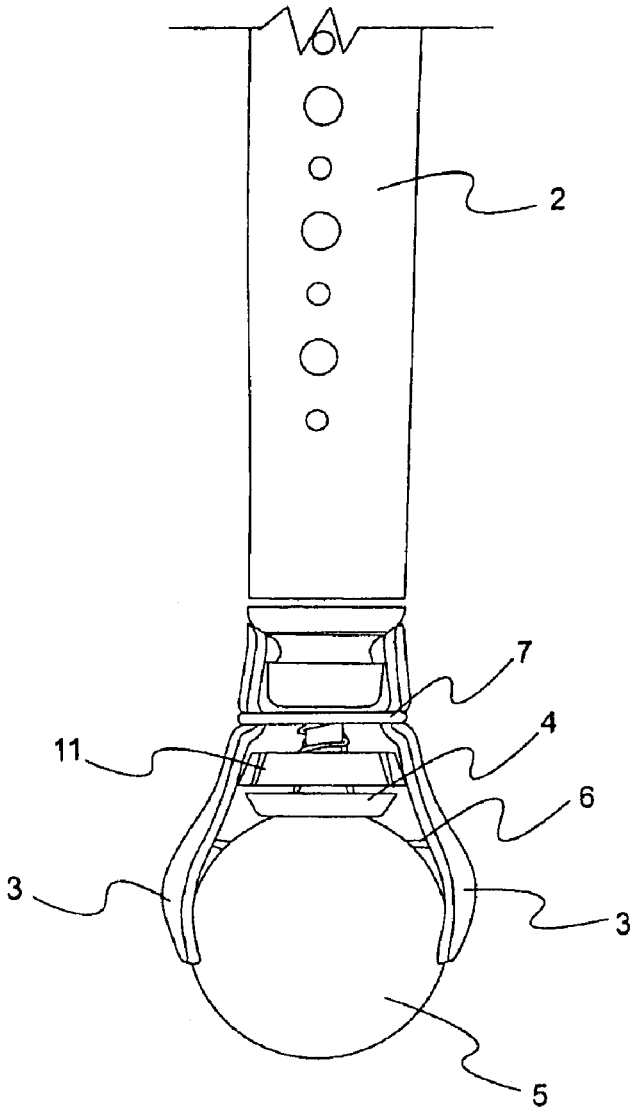
FIG. 4 is a view of the embodiment of FIG. 3 with a golf ball fully engaged.

The resilient torus 7 is partly expanded by the fingers, thereby causing it to urge the fingers back into the original position. Thus the fingers are urged against and grip the ball. This is shown in FIG. 4, where the ball is shown in a fully engaged position, but with one finger removed for clarity.

Figure 5:
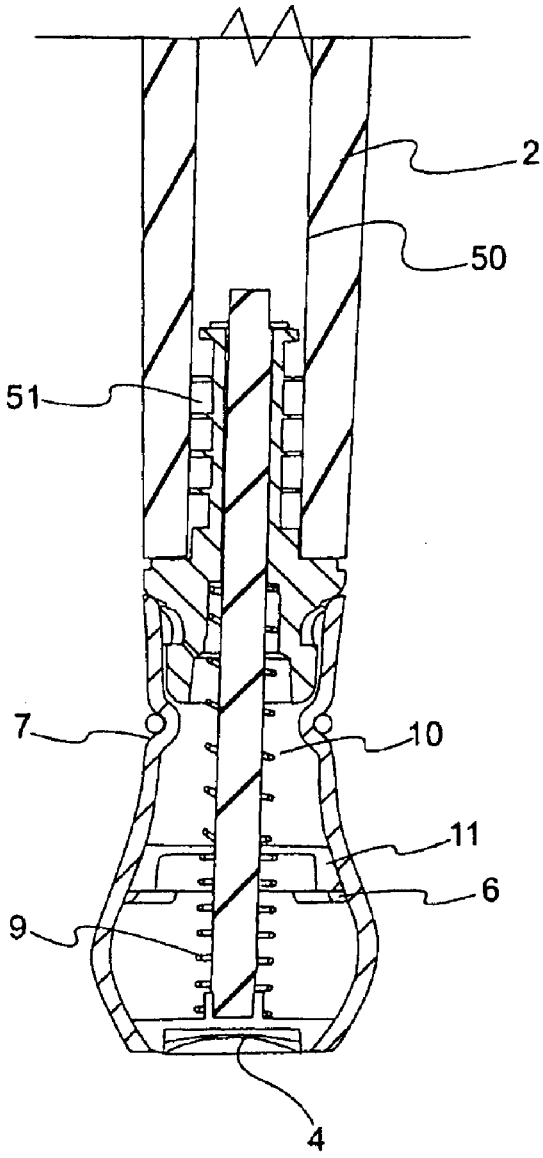
FIG. 5 is a cross-sectional view of the embodiment of FIG. 1.

Referring now to FIG. 5, it can be seen that the abutment 4 is supported by a shaft 8 which runs axially through the length of the golf ball retrieval device. Mounted to this shaft and free to move axially with respect to the shaft are a less stiff spring 9 and a stiffer spring 10. These are separated by a cup shaped washer 11, also mounted to the shaft and free to move axially with respect to the shaft. The end of the stiffer spring remote from the washer is supported by the tail piece 51 which is inserted into the club shaft 2.

Figure 6:
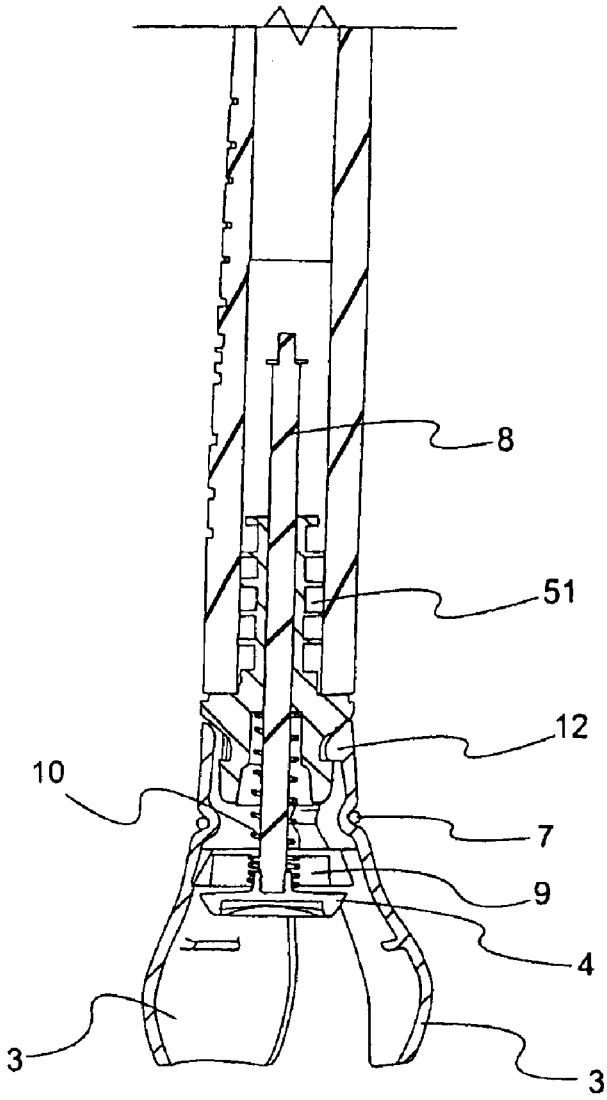
FIG. 6 is a cross-sectional view of the embodiment of FIG. 3.
Figure 7:
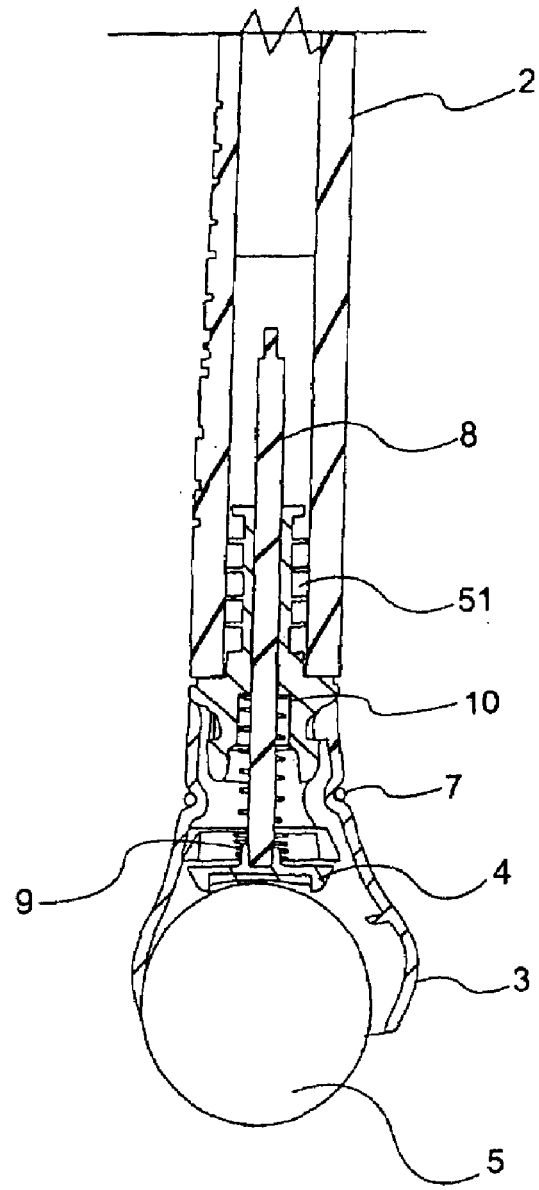
FIG. 7 is a cross-sectional view of the embodiment of FIG. 4.

Referring now to FIG. 6 and FIG. 7, which show the golf ball retrieval device in cross-section, when in the position where the ball is fully engaged. In FIG. 6, the ball is removed for clarity, but its gripped position can be seen in FIG. 7.

It can be seen that the less stiff spring 9 has fully compressed, allowing the abutment to move to close proximity to the washer. The shaft 8 has moved such that a portion of the shaft protruded beyond the tail piece 51 into the hollow shaft. The stiffer spring 10 has also substantially compressed, allowing the washer to move the pivot point where the fingers 3 meet the tail piece 51. The washer thus bears against the narrower part of the fingers, further urging the fingers apart.

As can be seen in FIG. 7, the resilient torus 7 continues to urge the fingers together, thus causing the ball to be gripped.

Although the invention has been herein shown and described in what is conceived to be the most practical and preferred embodiment, it is recognised that departures can be made within the scope of the invention, which is not to be limited to the details described herein but is to be accorded the full scope of the appended claims so as to embrace any and all equivalent devices and apparatus.

Throughout this specification the purpose has been to illustrate the invention and not to limit this.

The invention claimed is:

1. A golf ball retrieval device comprising:

a base adapted to be located on and secured to an upper end of a golf club shaft, wherein there is a shaft aligned to extend along an elongate axis of the base, said shaft supporting an abutment member at a forward end of the shaft so that when not in use this abutment member is positioned at an end distal from the base of the retrieval device;

at least two fingers projecting from the base substantially parallel to an axis running along the length of the club shaft; and a resilient support being provided at the base adapted to prevent a movement of the fingers in a direction parallel to the said axis while allowing each finger independently from the other finger or fingers to be movable with respect to the base so as to be pivoted about the base such that an end of the respective finger distal from the base will swing outwardly and allow thereby against resilient pressure a spread of the fingers to provide a golf ball capturing space;

wherein there is a spring effecting a bias to urge the shaft with the abutment member into an outward most position relative to the base, such that when the fingers are in a closed position where this is the resting position, the abutment member extends across an area between outer ends of the respective fingers.

2. The device of claim 1 wherein there are three fingers symmetrically aligned about the central axis of the body of the golf ball retrieval device.

3. A putter in combination with a device as in claim 1.

4. A putter as in claim 3 wherein the ball-retrieval device has a stern that is embedded in an end of a shaft of the putter.

5. A golf ball retrieval device comprising:

a base adapted to be located on and secured to an upper end of a golf club shaft, at least two fingers projecting from the base substantially parallel to an axis running along the length of the club shaft; and a resilient support being provided at the base adapted to prevent a movement of the fingers in a direction parallel to the said axis while allowing each finger independently from the other finger or fingers to be movable with respect to the base so as to be pivoted about the base such that an end of the respective finger distal from the base will swing outwardly and allow thereby against resilient pressure a spread of the fingers to provide a golf ball capturing space;

wherein there is a cam member slidably supported by a shaft and resiliently biased into an outwardmost position relative to the base which is inwardly moved relative to the fingers.

6. A device as in claim 5 wherein there is a helical spring between the said cam and the said base.

7. A golf ball retrieval device comprising:

a plurality of ball engaging members, an end abutment member;

a base member, the ball engaging members being held in a closely adjacent configuration by resilient means, said resilient means acting to prevent translation of the fingers with respect to the base member, thereby forming an open ended convolute sided cup shape, wherein the end abutment member covers an otherwise open area between the ends of the fingers distal from the base members;

wherein the abutment member is supported by a resilient support, said support being substantially co-axial with a longer axis of the convolute sided cup shape and is adapted to be pressed against a golf ball, whereby the support is deformed and the abutment member moves axially inside the convolute sided cup shape, remaining in contact with the ball, which ball comes into contact with the ball engaging members, which members are adapted to be forced apart by the force transmitted by the ball allowing the ball to move in between them, said members being urged to grip the ball by the resilient means;

the abutment member and the ball engaging members co-operating such that as the abutment member moves axially inside the convolute sided cup shape, the ball engaging members are forced further apart by the movement of the abutment member, allowing the ball to move completely between the ball engaging members, wherein the ball is held in place by the resilient means urging the ball engaging members against the ball, and by the resilient support urging the abutment member against the ball, further urging the ball against the ball engaging members.

8. The device of claim 7 wherein there are three fingers symmetrically aligned about the central axis of the body of the golf ball retrieval device.

9. A putter in combination with a device as in claim 7.

* * * * *